United States Patent [19]

Bjorklund

[11] 4,172,471

[45] Oct. 30, 1979

[54] VALVE UNIT

[76] Inventor: Curt A. Björklund, Box 99, Stenåsgatan, Ulricehamn, Sweden

[21] Appl. No.: 884,851

[22] Filed: Mar. 9, 1978

[30] Foreign Application Priority Data

Mar. 18, 1977 [SE] Sweden ..... 7703093

[51] Int. Cl.[2] ..... F16K 23/00; F15B 13/044

[52] U.S. Cl. ..... 137/887; 137/613; 137/625.65; 141/117; 222/108

[58] Field of Search ..... 141/115, 116, 117; 222/108, 109, 110; 137/625.65, 613, 877

[56] References Cited

U.S. PATENT DOCUMENTS

| | | | |
|---|---|---|---|
| 3,661,183 | 5/1972 | Komaroff et al. | 137/625.65 |
| 3,886,974 | 6/1975 | Bjorklund | 137/613 |
| 4,050,477 | 9/1977 | Acar | 137/625.65 |
| 4,134,428 | 1/1979 | Bjorklund | 137/882 |

*Primary Examiner*—Martin P. Schwadron

*Assistant Examiner*—A. Michael Chambers

*Attorney, Agent, or Firm*—Dann, Dorfman, Herrell and Skillman

[57] ABSTRACT

In a non-drip valve for a fluid flow line having a vacuum unit comprising supply chamber, a discharge chamber and a vacuum chamber connected to the discharge chamber to withdraw fluid therefrom when the forward flow is arrested, an improved control valve controlling the flow of fluid from a source to the supply chamber comprising a ball element operable between alternate positions, one of which admits fluid from the source of supply to the supply chamber and blocks the flow of fluid from the supply chamber to a return line, and the other of which blocks flow of fluids from the supply source to the supply chamber and simultaneously affords flow of fluid from the supply chamber to the return line, the position of said ball element being controlled by the armature of a solenoid.

7 Claims, 2 Drawing Figures

VALVE UNIT

Figure 1:
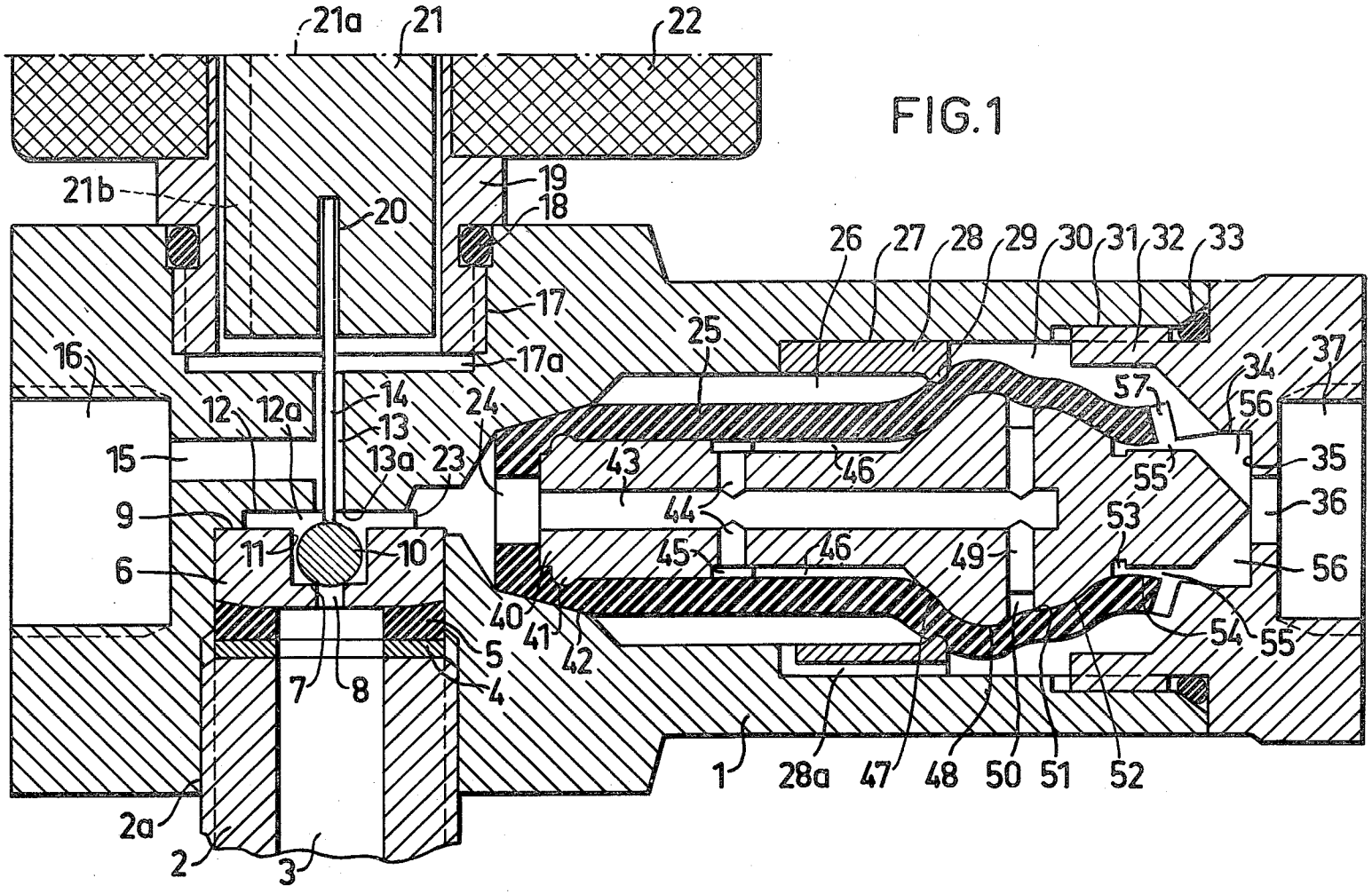

The present invention relates to a fluid valve and more particularly to a non-drip valve for liquids which may be quickly opened and closed upon demand and which is effective to limit post-drip of the liquid after the valve is closed.

The present invention is a further development of valves of the type shown in my U.S. Pat. No. 3,886,974 issued June 3, 1975 and in my copending U.S. patent application Ser. No. 825,586, filed Aug. 18, 1977. In particular, the present invention relates to a solenoid-operated valve which is simple and effective in operation.

Prior to the present invention, solenoid valves have not been fully effective for use in oil burners since they either are difficult to install or are slow in operation or tend to permit leakage through the valve.

With the foregoing in mind the primary objective of the present invention is to provide a solenoid-controlled valve unit which provides a non-drip characteristic after the valve is closed and is effective to prevent leakage through the valve during periods when the flow is arrested.

A further object of the present invention is to provide a unit of this character which is easily attachable to an oil burner and yet which is simple and fast in operation and is substantially leak-proof.

The present invention is also effective to provide a unit in which a rubber sleeve is actuated by the pressure differentials in the valve to withdraw fluid from the discharge chamber of the valve upon closure of the valve to constitute a vacuum unit, the configuration of the vacuum unit, including the location of an overflow channel for automatic air removal, and disposition of the channel in the distributor resulting in that the rubber quality has much less importance and that pressure variations can be held within $\pm 50$ g/cm$^2$ and resulting in a faster suckingback of the liquid and air after closure of the valve.

Practical tests with a number of valves of the present invention have shown that liquid-tightness and effective operation has been accomplished and that production is simple and easy. Units have been tested with 325,000 starts and 325,000 stops and no leakage or other defect has been noticed. Comparison tests with the best conventional two-way solenoid valves have shown that these have an average stop time from switching off of the electric current until the burner flame disappears in the order of 20/100 seconds resulting in after-dripping and an expansion of oil. As a result, the effectiveness of the nozzle and turbulator is soon reduced due to soot and carbonization. Units in accordance with the invention in the test showed an average stopping time between at least 5 times faster, i.e. approximately 4/100 seconds from the moment of interrupting the electric current until disappearance of the burner flame. Such a vacuum-cut-off valve has shown that in addition to its faster control, it is far better in operation that conventional valves and in addition thereto after drip and the disadvantages in connection with the expansion of oil are eliminated. In the test units, after said 325,000 starts and stops, the nozzle and turbulator were only slightly sooty and the efficiency was substantially the same as in the beginning of the tests. Such a number of starts and stops corresponds to 10 to 20 years normal operation, depending on the type of fumace used.

The construction of the unit enables installation in any position and accordingly the unit may be installed in the location which is best suited to the burner in question.

The valve unit of the present invention is designed to produce general improvement in the control of the fluid and provides a suitable combination of various means and characteristics which are entirely reliable in operation.

These objects are achieved in accordance with the present invention by the use of a single ball valve in the inlet of the unit, the element of said ball valve being controlled by the armature of a solenoid between alternate positions one of which opens the flow from the inlet to the supply chamber and closes the flow from the supply chamber to a return conduit, and the other of which closes the flow from the inlet to the supply chamber and opens flow from the supply chamber to the return conduit.

Further characteristics and advantages of the invention are set forth more fully hereinafter with reference to the accompanying drawings which illustrate a preferred embodiment.

Figure 2:
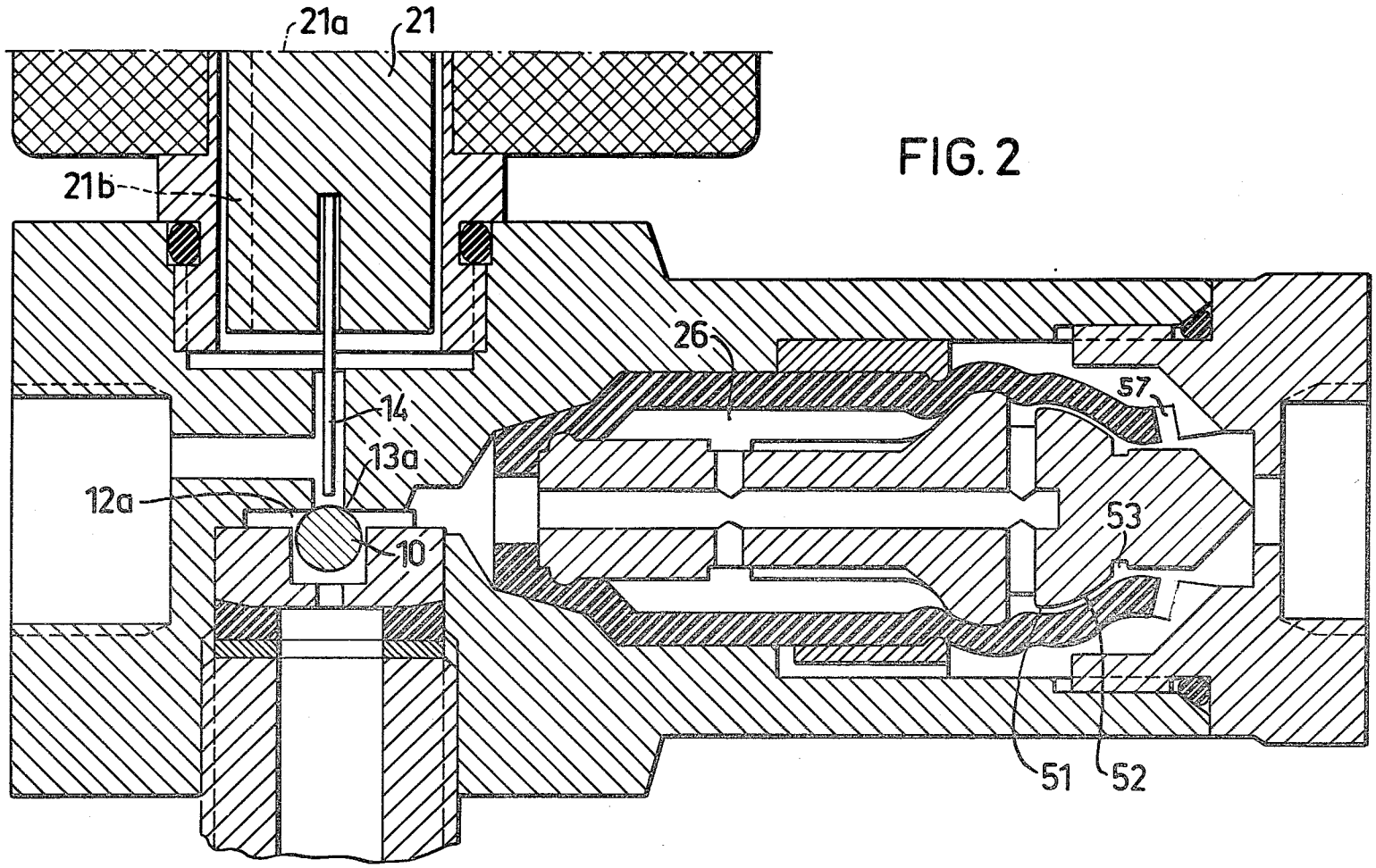

FIG. 1 shows a diametric longitudinal cross section of a valve unit in accordance with the present invention in the at-rest or cut-off position; and FIG. 2 is a similar view of the same unit in open or working position.

In the illustrated embodiment of the invention, the housing 1 has at one end a threaded bore 2*a* for receiving an inlet nipple 2 with an inlet channel 3. A valve insert 6 is positioned against a shoulder 9 in the bore 2*a* and is held in place by a gasket 5 and washer 4 when the nipple 2 is threaded into place. The valve insert 6 has a restricted orifice 8 terminating in a seat 7 for cooperating with a ball valve 10 which is displaceable in a bore 11 extending through the insert 6 from the shoulder 9 to the valve seat 7. The ball 10 is preferably steel and has sufficient clearance between it and the sides of the bore 11 to afford fluid flow therearound. Within the shoulder 9, the threaded bore 2*a* has a bottom recess 12 forming a cavity 12*a* communicating with the bore 11, and opening into a supply passage 23 of the vacuum unit. In axial registry with the orifice 8 and the seat 7, the bottom recess 12 has a channel 13 opening thereinto forming a seat 13*a* with which the ball 10 may cooperate. A control pin 14 of substantially less diameter than channel 13 extends axially through the channel 13 and is engaged at its upper end in the armature 21 of a solenoid 22. The solenoid has a bore 21*a* receiving a spring urging the armature downwardly and pressing the control pin against the ball so as to keep the ball 10 against the valve seat 7. The solenoid 22 is mounted by means of a mounting sleeve 19 sealed in a bore 17 by means of a gasket 18. Below the mounting sleeve 19, a cavity 17*a* communicates with the channel 13 at its lower side and communicates with a channel 21*b* in the armature 21 on its upper side. Intermediate the cavities 17*a* and 12*a*, the channel 13 communicates with a return channel 15 extending transversely into an outer bore 16 for a nipple or the like which connects the bore 16 to a return line, suction line, sump or the like.

As stated above, the cavity 12*a* communicates with the supply passage 23 for the vacuum unit. As shown, the vacuum unit has the supply passage 23 disposed at one end of a vacuum chamber 26 and is separated therefrom by a rubber sleeve expandible member 25 which encircles a regulating member or distributor 40 mounted in the vacuum chamber 26 so that the sleeve 25 bears against a transition 42 between the vacuum chamber 26 and the supply passage 23. At the other end of the vacuum chamber 26, it is recessed at 27 to receive an insert 28 having a circumferential heel or bead 29 bearing against the sleeve 25 to define the other end of the vacuum chamber 26. An overflow channel **28*a* is provided in the insert 28 to provide a restricted passageway from the vacuum chamber 26 to a discharge chamber 30 surrounding the remote end of the regulator 40 at the remote end of the housing 1. The discharge chamber 30 is closed by an outlet nut 32 threaded into the housing as indicated at 31 and sealed by an o-ring gasket 33. The nut 32 has a central bore 34 which engages the remote end of the regulator 40 and retains the same by an inwardly projecting shoulder 35 having an outlet channel 36 centrally therein. The outlet channel 36 communicates with a discharge bore 37 which may receive a nipple for connection to a burner line 38 and nozzle 39** (not shown).

The distributor or regulating member 40 has at its near end a circular heel or bead 41 circumscribing the member and engaging the sleeve 25 to anchor it on the member 40 against displacement. The member 40 has an axial channel 43 extending rearwardly therethrough from the inlet 24. Midway between the bead 41 and the circumferential bead 29, the channel 43 has cross bones 44 extending outwardly to communicate with a circumferential channel 45 and having axially extending branch channels 46 in the outer periphery of the member 40. The circumferential channel 45 and the axial branches 46 are disposed within the vacuum chamber which terminates at its remote end in an enlargement 47 of the member 40. The enlargement 47 cooperates with the circumferential heel 29 to sealingly engage the sleeve 25 therebetween. The outermost part 48 of the enlargement 47 insures closure of the vacuum chamber by the regulating member 40. The axial channel 43 of the member extends beyond the enlargement 47 and terminates in cross bores 49 which connect with a circumferential channel 50 which is enclosed by the remote part of the sleeve 25. The far edge of the channel 50 is rounded as indicated at 51 to permit the pressure of the liquid in the channel 50 to expand the sleeve 25 and afford a passageway 52 between the tail end of the member 40 and the tail end of the sleeve 25. Beyond the channel 50, a circular ring channel 53 is provided in the tail end 56 of the member 40. The tail end 56 fits neatly in the nut 32 and is provided with a series of radial slots 55 which afford communication between the outlet channel 36 and the circular ring channel 53. To insure proper mounting of the sleeve 25 on the member 40, a stop flange 57 is provided on the tail end 56. The flange ensures that there is clearance between the member 40 and the stop nut 32 so that there may be liquid flow between the vacuum chamber 26 through the channel **28*a* and the discharge chamber 30 to the outlet channel 36. As shown in FIG. 1, the resilient nature of the expandable sleeve 25 closes the channel 50 in the absence of pressure fluid in the axial channel 43, but permits expansion of the tail end of the sleeve 25 to open the passageway 52 as shown in FIG. 2 when fluid pressure exists in the channel 43. It is noted that when there is pressure fluid in the channel 43, it is transmitted radially against the interior of the sleeve 25 in the vacuum chamber to expand the sleeve 25 against the outer wall of the vacuum chamber as shown in FIG. 2, the fluid surrounding the sleeve 25 in the vacuum chamber being discharged through the passageway 28*a* to the discharge chamber 30**.

In operation of the illustrated embodiment of the unit, FIG. 1 shows the unit in the at-rest or preblowing position. The pressure of the oil in the burner pump which is connected to the inlet bore 3 bears against the spherical valve element 10 which is kept in closing position against the seat 7 by the spring bias of the solenoid 22, through the control pin 14.

When the pre-blowing time is over, the solenoid 22 is energized and the armature 21 is displaced to the position shown in FIG. 2. The displacement is very fast, since the oil pressure in the bore 3 through the orifice 8 assits in moving the ball valve 10 to displace the pin 14 and the armature 21. The spring is compressed and oil passes from above the armature 21 through the channel **21*b* to the cavity 17*a* provided below the mounting sleeve 17. The upward displacement of the ball 10 causes the ball to seat against the seat 3*a* at the bottom of the channel 13, assisted by reason of full pressure being admitted to the supply passage 23 by oil passing around the ball 10 in the bore 11. The pressure on the underside of the ball thereby assists in sealing the ball against the seat 13*a* and closing the channel 13. Oil in the channel 13 may flow into the return line through the return bore 16**.

With the supply passage 23 connected to inlet bore 3, oil may now pass through the inlet 24 into the axial bore 43. By reason of the constriction of the sleeve 25 against the tail end of the member 40, restricting flow through the axial passageway 48, oil flows through the passageways 44 into the circumferential channel 45 and the branch channels 46 and the pressure of the oil expands the expandable sleeve as shown in FIG. 2. The expansion of the sleeve in the vacuum chamber 26 expresses oil from outside of the sleeve 25 through the overflow channel **28*a* into the discharge channel 30 and through the slots 56 to the outlet channel 36 and from thence to the burner line 38 and nozzle 39, providing fuel for combustion. This affords a fast start without leaking or dripping since a quantity of air sucked back during the preceding stopping operation is discharged with the oil from the vacuum chamber. Upon evacuation of the oil from the vacuum chamber surrounding the sleeve 25, oil is then free to flow through the axial channel 43 into the circumferential channel 45 and through the passageway 52 between the sleeve 25 and the tail end of the member 40 into the slots 56 whereby flow of oil to the burner nozzle continues. Inasmuch as the sleeve 25 has expanded to block the mount of the overflow channel 28*a* any counter pressure from the discharge chamber 30 cannot affect the expanded sleeve 25 in the vacuum chamber. As the expanded sleeve 25 subsequently contracts, the beads or heels 41 and 29 effectively anchor the sleeve against longitudinal displacement and maintain the vacuum chamber 26 substantially liquid-tight. The resistance provided by the contraction of the sleeve 25 against the passageway 52 between the sleeve and the tail end insures a steady flow upon the presence of liquid pressure in the axial bore 43**.

When combustion is terminated, the solenoid 22 is de-energized and the armature 21 moves to its at-rest position under the influence of the spring bias. Displacement of the armature brings the control pin 14 into direct contact with the ball element 10, the channel **21*b* affording free movement of the armature 21, and the valve element 10 is rapidly shifted from the seat 13*a* to a position against the seat 7. This displacement of the valve element 10, opens the channel 13 to the supply passage 23 and reduces the pressure in the cavity 12***a*. This reduction is enhanced considerably if the return bore 16 is connected to the suction side of the pump (in one-line systems) or to a negative pressure return line (in two-line systems). The rapid reduction in pressure in the supply line 23 and inlet 24 of the vacuum unit renders the vacuum unit operative to equalize the pressure, to ensure closure of the valve element 10 against seat 7, as shown in FIG. 1. The displacement of the solenoid armature 21 and the dimensions of the control pin 14 may be regulated or selected to insure that the spring bias on the armature is sufficient to overcome the counter pressure of the oil in the orifice 8. The rapid closure of the valve element 10 against the seat 7 is enhanced by the operation of the vacuum unit which, as a result of the contraction of the sleeve 25 forces oil from the interior of the sleeve in the vacuum chamber 26 inwardly through the bore 44 and the axial bore 43 back to the supply chamber. For this reason the solenoid 22 may be designed to operate with small power consumption. Since the valve element 10 has opened the channel 13, and since the channel 15 is substantially greater in cross section than the channel 13, there is no damage of back pressure on the armature 21 from damaging the solenoid, thereby assisting in safe operation of low-power component.

The reduction in pressure in the cavity 12*a* is rapidly transmitted in the circumferential channel 50 at the tail end of the regulating member 40 so that the sleeve contracts against the tail end and closes the passageway 52. This closure of the passageway 52 is almost instantaneous after the ball element 10 is displaced from the seat 13*a*. Oil inside the sleeve within the vacuum chamber 26 is quickly discharged into the return line as the sleeve 25 contracts. Simultaneously oil is sucked in from the burner line and nozzle reversely through the outlet 36, the discharge chamber 30 and the relief channel 28*a* into the vacuum chamber 26 surrounding the sleeve. Along with the oil, a small quantity of air is drawn in, thereby preventing substantially all after-drip and providing space for expansion of the oil if needed, as would normally occur after a period of rest between the stopping and starting. Since air is drawn into the unit, the oil expansion normally is permitted by the discharge of such air. Therefore, carbonization and sooting fail to materialize. It is noted that the branch channels 46 surrounding the regulation element 40 in the suction chamber 26 assist in affording complete collapse of the sleeve element against the member 40 in the final stages of the suction operation.

Of significant importance in the present invention, the rapid response of the valve 10 contributes to the effective operation of the unit. This, in turn, is affected by the relief provided by the enlarged diameter of the channel 15 relative to the channel 13. The operation of the vacuum unit is enhanced by the positive sealing afforded by the heels or beads 41 and 29 with the flexible sleeve 25 and the provision of the branch channel 46 extending axially under the expansible sleeve 25 which affords rapid displacement of the sleeve between its opposite limit positions. The check-valve-like operation of the sleeve against the channel 50 enables greater tolerance in the selection of materials for the expansible sleeve 25.

In addition to the foregoing characteristics, it is noted that the gasket 5 is responsible to the pressure in the liquid in the inlet 3 during the pre-blowing. The clearance between the spherical valve element 10 and the walls of the bore 11 should be selected to insure rapid displacement of the ball element between the seat 7 and the seat 13*a*. It has been found that when the solenoid displaces the valve element 10 from its seat 13*a*, the tail end of the sleeve effectively shuts off the flow at 52 in 1/100 to 2/100 seconds, and the reverse flow provided by the collapse of the sleeve 25 contributes to the rapid seating of the valve element 10 against the seat 7. The control pin 14 is designed to cooperate to displace the valve element 10 regardless of the orientation of the unit, so that the unit is not dependent upon the force of gravity for operation. The pin may fit loosely in the armature, or may be anchored therein by friction or by an adhesive. In like manner, the bore 11 guides the valve element 10 in its displacement to insure proper closing of the valve element 10 against the seats 13*a* and 7, respectively.

It should be apparent that with the foregoing description, the particular configuration and arrangement of the various slots and passages may be altered to accommodate to the requirements of the particular situation so as to insure satisfactory operation. By proper location of the peripheral channel 53 relative to the channel 50, compensation for variations in the characteristics of the sleeve 25 may be achieved.

The distance between the channels 50 and 53 may be selected to accommodate to the different characteristics of the expansion sleeve 25. In this way, different lengths of the flow path in the distance between the two channels are overcome to avoid the wide pressure variations which would otherwise occur.

While a particular embodiment of the present invention has been herein illustrated and described, it is not intended to limit the invention to such disclosure, but changes and modifications may be made therein and thereto within the scope of the following claims.

I claim:

1. A non-drip valve unit for regulating a fluid flow from an inlet to an outlet, comprising a valve housing providing said inlet at one end and said outlet at the other end, a supply chamber connected to said inlet by a passage, and a return conduit connected to said passage between said inlet and said supply chamber, a discharge chamber connected to said outlet, and a vacuum chamber intermediate said supply and discharge chambers, a distributor element surrounded by a rubber sleeve both said element and said sleeve being mounted in said vacuum chamber and having portions extending axially into said discharge chamber, a portion of said sleeve bearing against said housing between said vacuum and supply chambers, said element having an inlet opening communicating with an axial channel ending blindly in said element and said element having a first cross bore in said vacuum chamber and a second cross bore in said portion of said element extending into said discharge chamber, passage means in said housing connecting said inlet opening with said chamber to afford expansion of said sleeve portion in said vacuum chamber in response to fluid pressure in said supply chamber through said passage means, inlet opening, axial channel and said first cross bore, and opening the end of said sleeve portion in said discharge chamber in response to fluid pressure in said supply chamber, through said passage means, inlet opening, axial channel and said second cross bore to allow communication of said fluid flow from said inlet to said outlet, and also to connect said inlet with said discharge chamber, and relieve channel means interconnecting said vacuum and discharge chambers externally of said sleeve, said valve unit characterized by a ball valve element in said supply chamber, first and second opposing valve seats in said supply chamber, said first valve seat adjacaent said return conduit and said second valve seat adjacent said inlet wall means in said valve housing supply chamber guiding said element for displacement alternatively between said seats, and a solenoid mounted on said housing having an armature mounted for axial displacement in said solenoid and operable when said solenoid is deenergized to press said valve element against the flow of fluid in said inlet against said second seat to close said inlet and open said supply chamber to said return conduit, said armature operable upon energization of said solenoid to allow said valve element to open said inlet, fluid pressure from said inlet moving said valve element against said first seat to close said return conduit.

2. A valve unit according to claim 1, wherein said bores terminate in outer ring channels disposed respectively in said vacuum chamber and in said discharge chamber, said sleeve surrounding said channels in said chambers, said sleeve being sealed against said distributor element on both sides of the ring channel in said vacuum chamber and on only one side of the ring channel in said discharge chamber to thereby afford flow from said inlet into said latter ring channel and past said sleeve into said discharge chamber.

3. A valve unit according to claim 2, wherein the outer ring channel in said vacuum channel has branch channels connected thereto extendin axially along the outer periphery of said distributor element within said vacuum chamber.

4. A valve unit according to claim 2, wherein said distributor element is surrounded by a groove disposed in said discharge chamber, said groove being covered by said sleeve at the unsealed side of the ring channel in said discharge chamber, and axial slots connecting said groove to said outlet, the space between ring channel and said groove serving as a pressure-regulating passage.

5. A valve unit according to claim 4, wherein along the periphery of said distributor element a stop flange is disposed to engage the unsealed end of said sleeve which faces the outlet.

6. Valve unit according to claim 2, wherein the tail end of said distributor element facing said outlet diverges towards said outlet, said tail end having axial slots affording communication between said discharge chamber and said outlet.

7. Valve unit according to claim 2, wherein between said vacuum chamber and said discharge chamber, said distributor element having an enlarged portion to compress said sleeve against the valve housing and separate said chambers, said valve housing having abutment means cooperating with said enlarged portion and including said relief channel means between said chambers.

* * * * *